US010591203B2

(12) United States Patent
Kang et al.

(10) Patent No.: US 10,591,203 B2
(45) Date of Patent: Mar. 17, 2020

(54) REFRIGERATOR

(71) Applicant: SAMSUNG ELECTRONICS CO., LTD., Suwon-si, Gyeonggi-do (KR)

(72) Inventors: Byeong Kook Kang, Gwangju (KR); Jong Sun Park, Suwon-si (KR); Byoung-Jae Cho, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/367,747

(22) Filed: Dec. 2, 2016

(65) Prior Publication Data

US 2017/0160002 A1 Jun. 8, 2017

(30) Foreign Application Priority Data

Dec. 4, 2015 (KR) ..... 10-2015-0171940

(51) Int. Cl.

| | |
|---|---|
| ***F25D 25/00*** | (2006.01) |
| ***F25D 25/02*** | (2006.01) |
| ***F25D 11/02*** | (2006.01) |
| ***F25D 23/04*** | (2006.01) |
| *F25D 23/06* | (2006.01) |

(52) U.S. Cl.

CPC ..... *F25D 25/025* (2013.01); *F25D 11/02* (2013.01); *F25D 23/04* (2013.01); *A47B 2210/0037* (2013.01); *A47B 2210/0056* (2013.01); *A47B 2210/0059* (2013.01); *A47B 2210/175* (2013.01); *F25D 23/066* (2013.01); *F25D 23/067* (2013.01); *F25D 2201/12* (2013.01); *F25D 2201/14* (2013.01)

(58) Field of Classification Search

CPC ..... F25D 23/04; F25D 25/025; F25D 11/02
USPC ..... 312/401, 402, 404, 408, 330.1; 62/382
See application file for complete search history.

(56) References Cited

U.S. PATENT DOCUMENTS 2,490,494 A * 12/1949 Widman ..... F25D 25/00 312/301
5,918,959 A * 7/1999 Lee ..... F25D 25/025 312/330.1

(Continued)

FOREIGN PATENT DOCUMENTS

CN 101171489 4/2008
CN 103827611 5/2014

(Continued)

OTHER PUBLICATIONS

Extended European Search Report dated Apr. 3, 2017 in corresponding European Patent Application No. 16 20 2015.

(Continued)

*Primary Examiner* — James O Hansen
(74) *Attorney, Agent, or Firm* — Staas & Halsey LLP

(57) ABSTRACT

A refrigerator includes a storage container configured to slide into and out of a storage compartment and a rail unit configured to guide movement of the storage container and a support member disposed in the storage compartment to support the rail unit and coupled to a bottom side of an inner case. Guide bars that guide movement of the storage containers are installed at lower ends of the storage container. Roller units are installed at the bottom surface of the storage compartment by using the foam insulation material blown into the space between the inner case and the outer case.

10 Claims, 16 Drawing Sheets

(56) References Cited

U.S. PATENT DOCUMENTS

| | | | | |
|---|---|---|---|---|
| 8,398,187 | B2 * | 3/2013 | Benz | F25D 25/025 312/404 |
| 2009/0056365 | A1 | 3/2009 | Benz et al. | |
| 2009/0223242 | A1 | 9/2009 | Nam et al. | |
| 2011/0127896 | A1 | 6/2011 | Anderson et al. | |
| 2014/0265801 | A1 * | 9/2014 | Klitzing | F25D 25/025 312/404 |

FOREIGN PATENT DOCUMENTS

| | | |
|---|---|---|
| EP | 2 682 698 | 1/2014 |
| JP | 5-27588 | 4/1993 |
| JP | 10-300334 | 11/1998 |
| WO | 2013/042338 | 3/2013 |

OTHER PUBLICATIONS

European Communication dated Jun. 12, 2018 in European Patent Application No. 16202015.0.
Chinese Office Action dated Nov. 2, 2018 in Chinese Patent Application No. 201611101495.2.
European Communication dated Jan. 25, 2019 in European Patent Application No. 16 202 015.0 (6 pages).
Chinese Office Action dated Jul. 11, 2019 in related Chinese Application No. 201611101495.2 with English translation (16 pages).

* cited by examiner

REFRIGERATOR

CROSS-REFERENCE TO RELATED APPLICATIONS

This application claims the priority benefit of Korean Patent Application No. 10-2015-0171940, filed on Dec. 4, 2015 in the Korean Intellectual Property Office, the disclosure of which is incorporated herein by reference.

BACKGROUND

1. Field

Embodiments of the present disclosure relate to refrigerators having storage containers sliding into and out of a storage compartment.

2. Description of the Related Art

A refrigerator includes a main body having a storage compartment and a cool air supply system configured to supply cool air into the storage compartment.

The storage compartment may accommodate storage containers sliding into and out of the storage compartment. To this end, the storage compartment may be provided with a rail unit to guide movement of the storage containers.

In general, guide bars are disposed at upper ends of both side walls of a storage container, and rail units are installed at both side surfaces of a storage compartment to support the guide bars. Alternatively, rail unit are integrated into shelves of the storage compartment.

A storage container may have a shape in which an upper width of a side wall is greater than a lower width for the convenience of a user to put/take food into/out of the storage container. However, if the container has the aforementioned structure, in which the guide bars are installed at the upper ends of the side walls of the storage container, an effective space of the storage compartment decreases in comparison with a structure in which guide bars are disposed at lower ends of the side walls of the storage container.

Therefore, a wasted space may be reduced by using the guide bars installed at the lower ends of the side walls of the storage container, and thus there is a need to improve the structure and alignment of the rail units.

SUMMARY

Therefore, it is an aspect of the present disclosure to provide a refrigerator including a storage container provided with guide bars installed at lower ends of side walls thereof to reduce a wasted space of a storage compartment and rail units configured to support the storage container.

It is another aspect of the present disclosure to provide a refrigerator including rail units installed on a bottom surface of a storage compartment.

It is another aspect of the present disclosure to provide a refrigerator including rail units fixed by using a foam insulation material in a self-inserting method without using a separate coupling member.

Additional aspects of the disclosure will be set forth in part in the description which follows and, in part, will be obvious from the description, or may be learned by practice of the disclosure.

In accordance with an aspect of the present disclosure, a refrigerator includes an inner case, in which a storage compartment is formed, having a top side, a bottom side, both sides, and a rear side surrounding the storage compartment, an outer case coupled to outer surfaces of the inner case, a foam insulation material blown into a space between the inner case and the outer case, a storage container configured to slide into and out of the storage compartment; a rail unit configured to guide movement of the storage container; and a support member disposed in the storage compartment to support the rail unit and coupled to the bottom side.

The support member may be fixed by the foam insulation material.

The support member may comprise a coupling protrusion configured to pass through the bottom side and contact the foam insulation material to be supported by the foam insulation material.

The bottom side may have a coupling hole through which the coupling protrusion passes.

The support member may be temporarily assembled to the bottom side as the coupling protrusion is inserted into the coupling hole and slides thereinto.

The foam insulation material may be blown into the space between the inner case and the outer case after the support member is temporarily assembled to the bottom side.

The rail unit may be coupled to the support member after blowing the foam insulation material into the space between the inner case and the outer case.

The rail unit may be coupled to the support member as a portion of the rail unit is slidably inserted into the support member.

The rail unit may have an insertion protrusion to be coupled to the support member.

The support member may comprise a hook portion constituting an insertion groove into which the insertion protrusion is inserted.

The hook portion may be elastically deformed as the insertion protrusion is inserted into the insertion groove and coupling of the rail unit and the support member may be maintained by pressing the insertion protrusion with elasticity.

In accordance with another aspect of the present disclosure, a refrigerator includes a main body, a storage compartment formed in the main body; a storage container configured to slide into and out of the storage compartment, a side rail unit installed at a side surface of the storage compartment to support one side of the storage container; and a central rail unit installed at a bottom surface of the storage compartment to support the opposite side of the storage container.

The refrigerator may include a support member disposed in the storage compartment to support the central rail unit and coupled to the bottom surface of the storage compartment.

The main body may include an inner case having side surfaces and a bottom surface of the storage compartment in which the storage compartment is formed; an outer case coupled to outer surfaces of the inner case, and a foam insulation material blown into a space between the inner case and the outer case, wherein the support member may be fixed by the foam insulation material.

The storage container may include a body having a storage space and guide units disposed at lower ends of both sides of the body.

The guide unit may include a guide bar extending in a forward-backward direction, and a guide roller disposed behind the guide bar.

The side rail unit and the central rail unit may include a guide bar accommodation unit to accommodate the guide bar.

The side rail unit and the central rail unit may include a roller support surface to support the guide roller.

The side rail unit and the central rail unit may include a rail roller to support the guide bar.

BRIEF DESCRIPTION OF THE DRAWINGS

These and/or other aspects of the disclosure will become apparent and more readily appreciated from the following description of the embodiments, taken in conjunction with the accompanying drawings.

DETAILED DESCRIPTION

Figure 1:
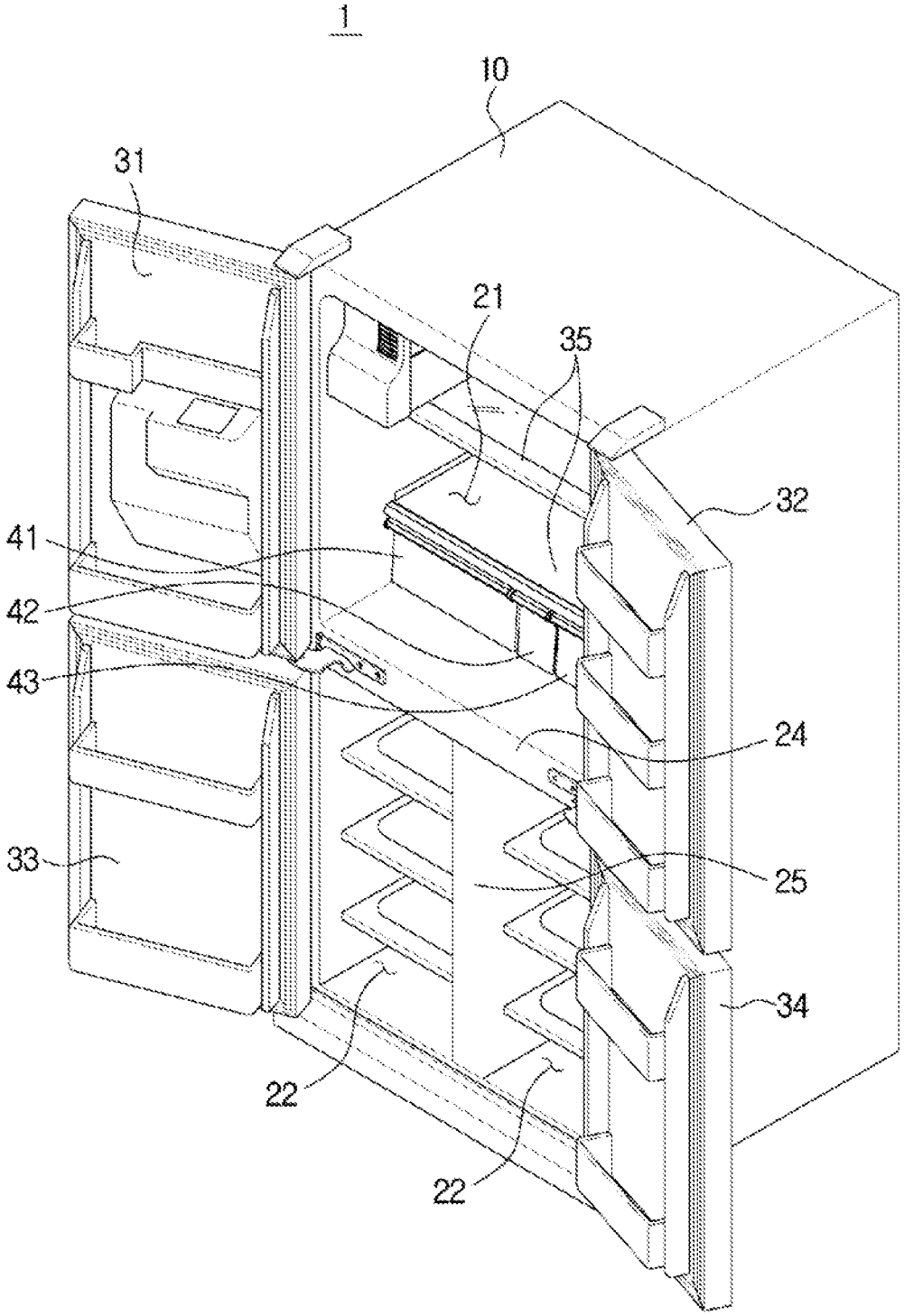
FIG. 1 is a perspective view of a refrigerator according to an embodiment.

Reference will now be made in detail to the embodiments of the present disclosure, examples of which are illustrated in the accompanying drawings. The embodiments described in the specification and shown in the drawings are only illustrative and are not intended to represent all aspects of the invention, such that various equivalents and modifications may be made without departing from the spirit of the invention.

In the drawings, like reference numerals denote like elements, and elements may be enlarged or exaggerated for clarity.

Unless expressly described otherwise, all terms including descriptive or technical terms used herein should be construed as having meanings that are obvious to one of ordinary skill in the art.

It should be understood that the terms used in the specification and appended claims should not be construed as limited to general and dictionary meanings but should be construed based on the meanings and concepts according to the spirit of the present disclosure on the basis of the principle that the inventor is permitted to define appropriate terms for best explanation.

It will be understood that, although the terms "first", "second", etc., may be used herein to describe various elements, these elements should not be limited by these terms. The above terms are used only to distinguish one component from another.

Throughout the specification, a singular form may include plural forms, unless there is a particular description contrary thereto.

In the present specification, it is to be understood that the terms such as "including" or "having," etc., are intended to indicate the existence of the components, features, numbers, steps, operations, or combinations thereof disclosed in the specification, and are not intended to preclude the possibility that one or more other components, features, numbers, steps, operations, or combinations thereof may exist or may be added.

It will be understood that if one element is located "in front of", "behind, "on", "under", "on the left of" or "on the right of" another element, it can be directly or indirectly located "in front of", "behind, "on", "under", "on the left of" or "on the right of" the element. That is, a third intervening element may be present therebetween.

Hereinafter, embodiments of the present disclosure will be described in detail with reference to the accompanying drawings.

Figure 2:
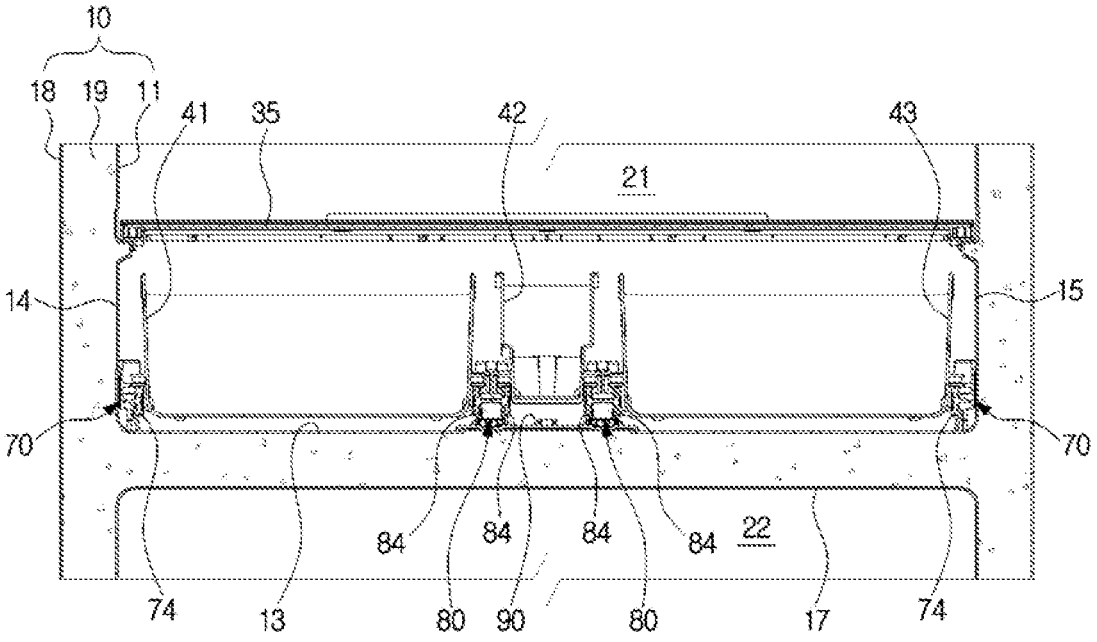
FIG. 2 is a front cross-sectional view of storage containers and rail units of the refrigerator of FIG. 1 (in which a partition wall 25 is omitted).
Figure 3:
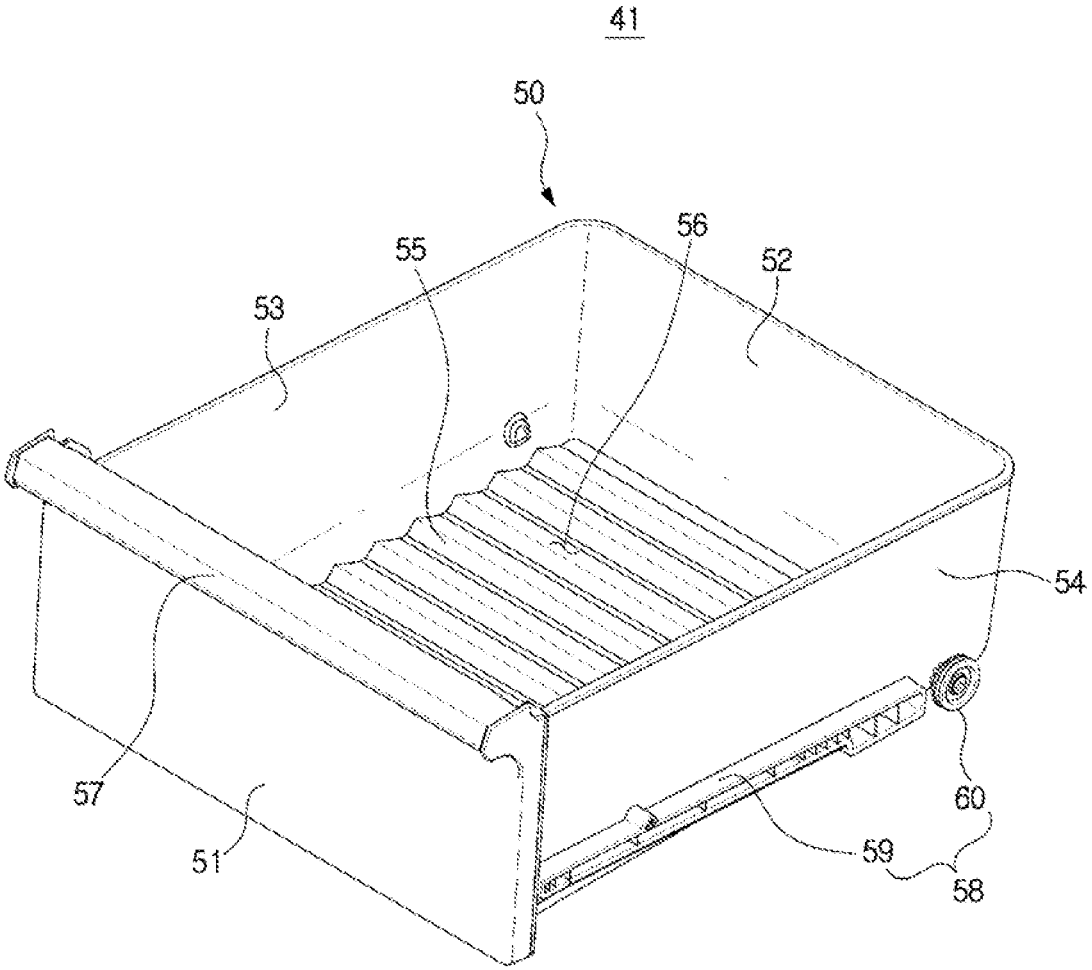
FIG. 3 is a perspective view of a storage container of the refrigerator of FIG. 1.
Figure 4:
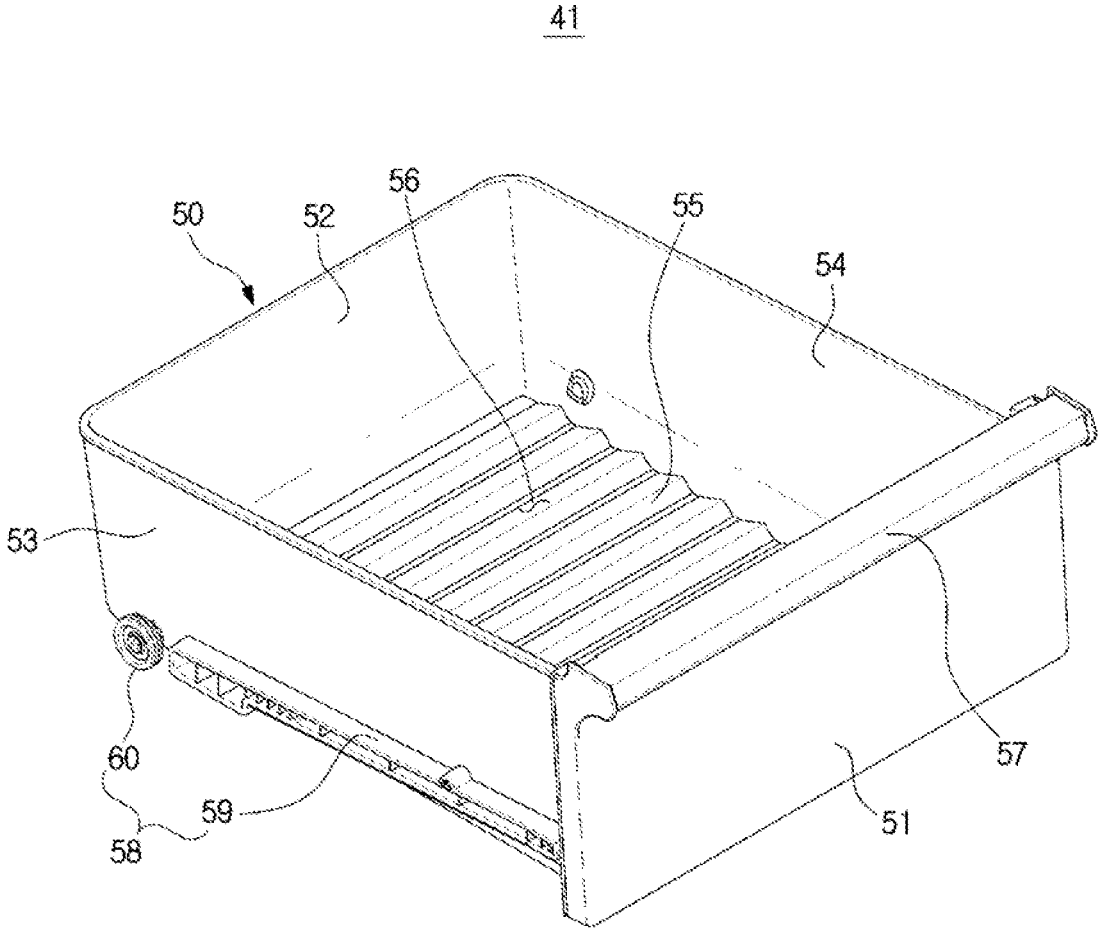
FIG. 4 is a perspective view of a storage container of the refrigerator of FIG. 1 from a different angle.
Figure 5:
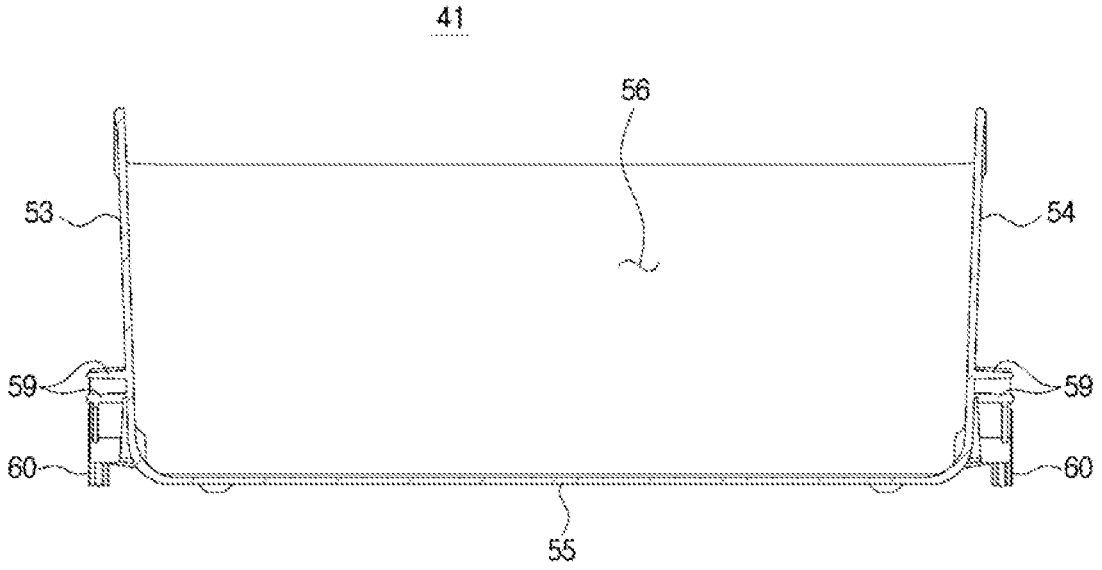
FIG. 5 is a front cross-sectional view of a storage container of the refrigerator of FIG. 1.
Figure 6:
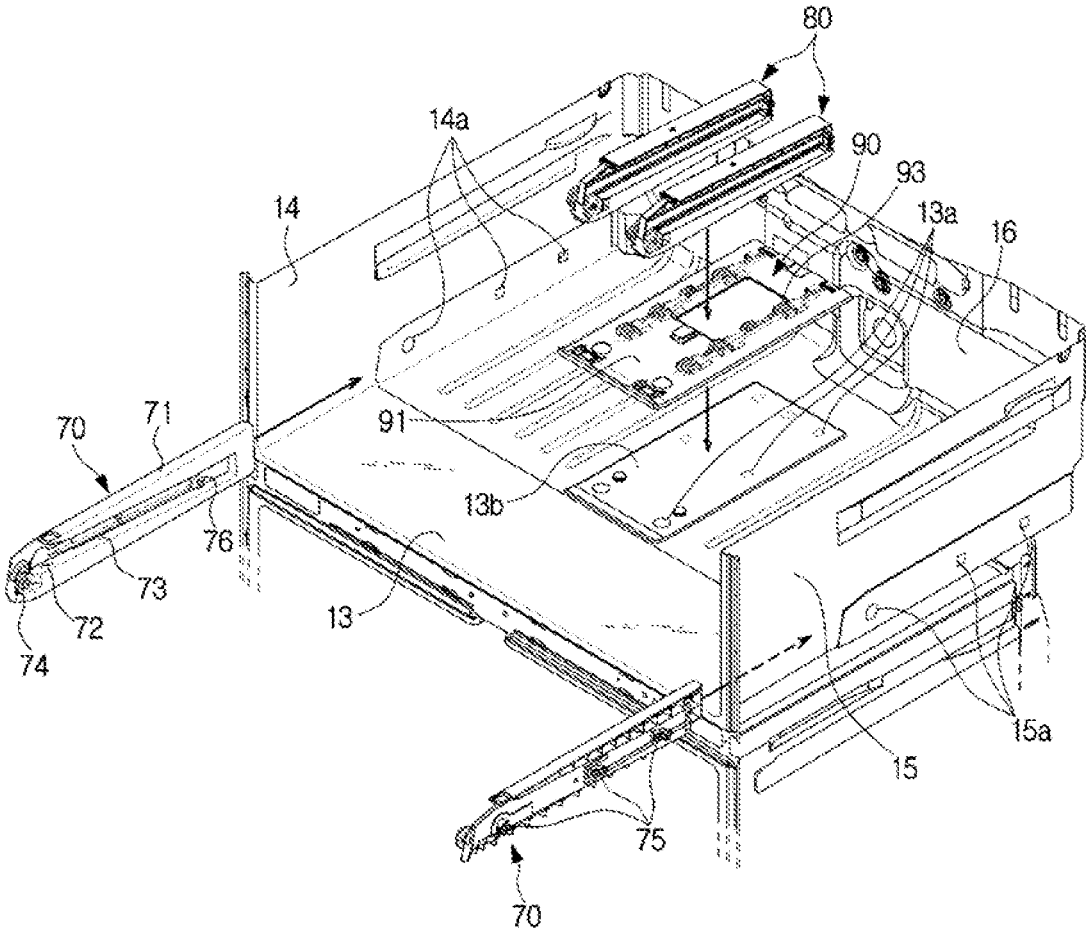
FIG. 6 is a view of rail units separated from an inner case of the refrigerator of FIG. 1.
Figure 7:
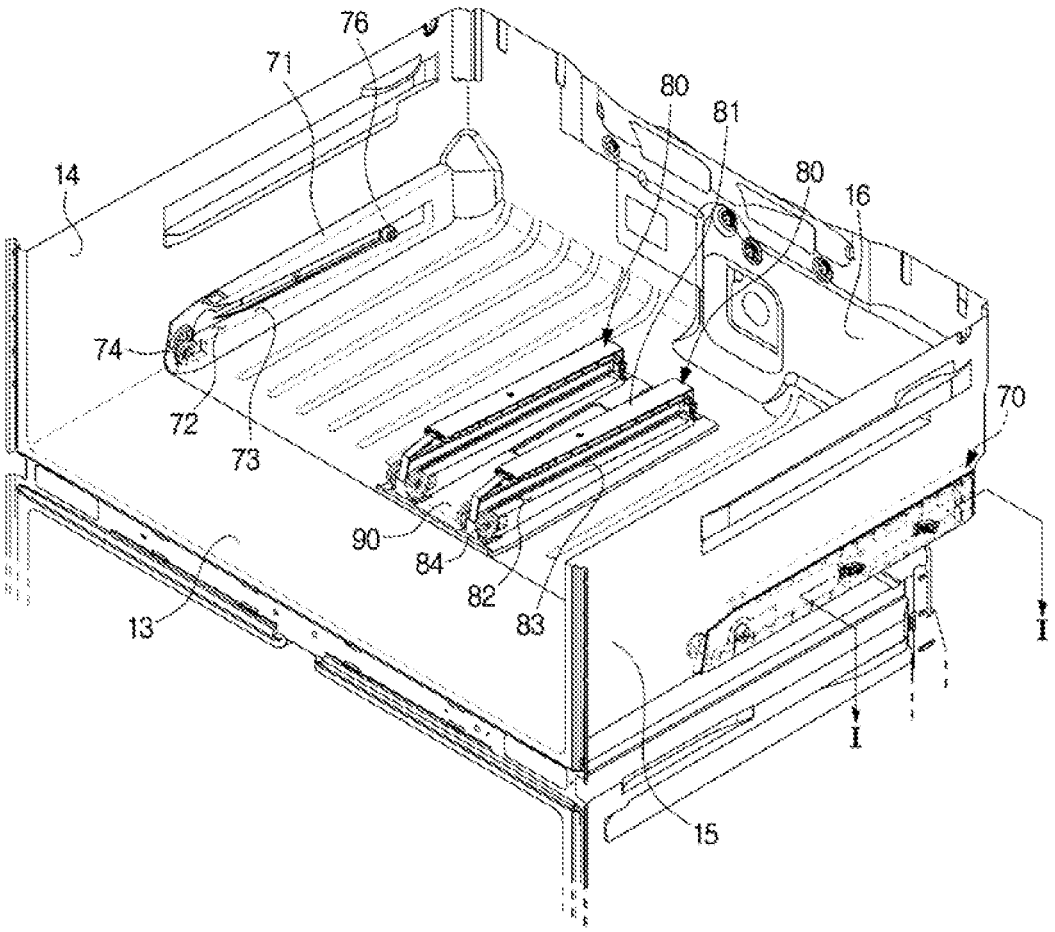
FIG. 7 is a view illustrating rail units installed in the inner case of the refrigerator of FIG. 1.
Figure 8:
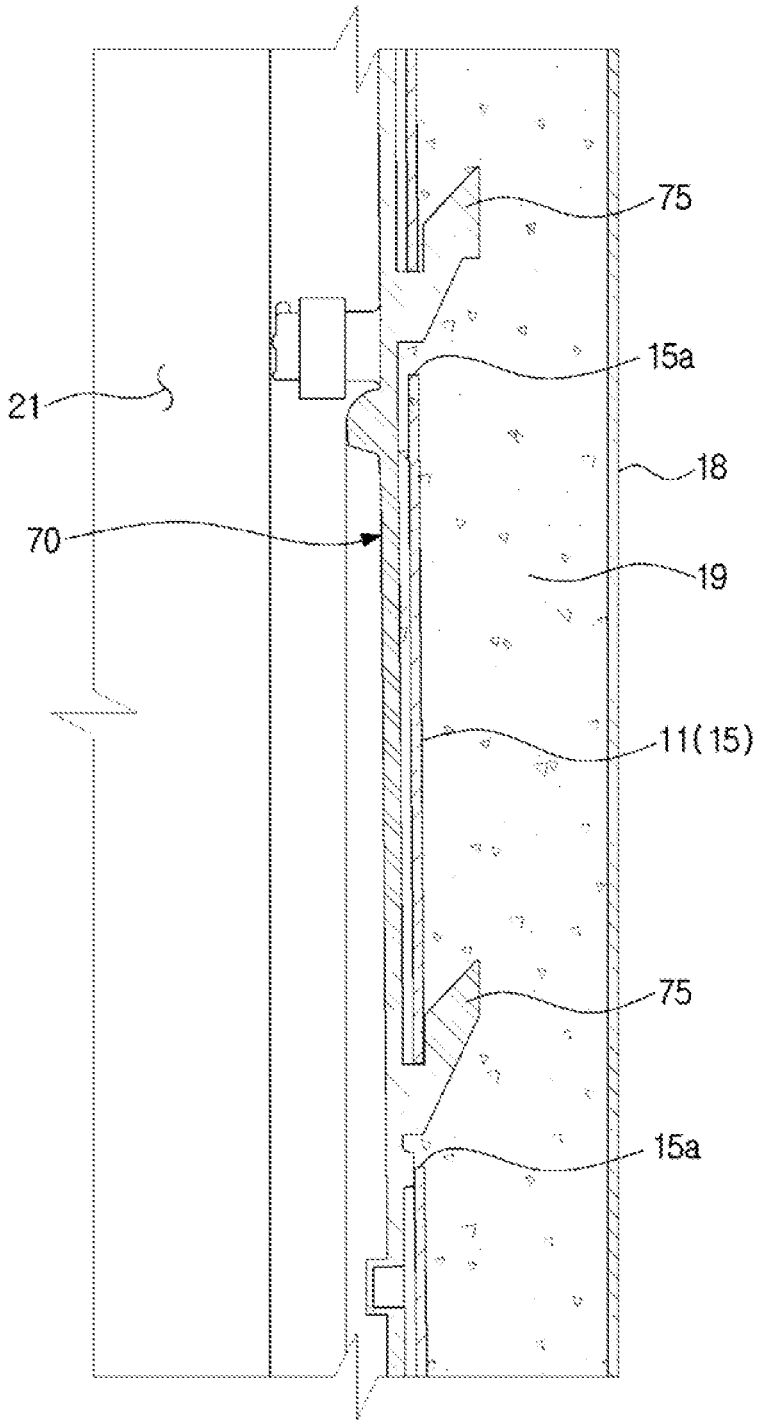
FIG. 8 is a cross-sectional view taken along line I-I of FIG. 7 illustrating a structure in which a side rail unit is fixed to a side surface of a storage compartment by a foam insulation material.

FIG. 1 is a perspective view of a refrigerator according to an embodiment. FIG. 2 is a front cross-sectional view of storage containers and rail units of the refrigerator of FIG. 1 (in which a partition wall 25 is omitted). FIG. 3 is a perspective view of a storage container of the refrigerator of FIG. 1. FIG. 4 is a perspective view of a storage container of the refrigerator of FIG. 1 from a different angle. FIG. 5 is a front cross-sectional view of a storage container of the refrigerator of FIG. 1. FIG. 6 is a view of rail units separated from an inner case of the refrigerator of FIG. 1. FIG. 7 is a view illustrating rail units installed in the inner case of the refrigerator of FIG. 1. FIG. 8 is a cross-sectional view taken along line I-I of FIG. 7 illustrating a structure in which a side rail unit is fixed to a side surface of a storage compartment by a foam insulation material.

A refrigerator according to an embodiment is described with reference to FIGS. 1 to 8.

A refrigerator 1 includes a main body 10, storage compartments 21 and 22 formed in the main body 10 to store food, a cool air supply system (not shown) configured to supply cool air to the storage compartments 21 and 22, and doors 31, 32, 33, and 34 configured to open and close the storage compartments 21 and 22.

The storage compartments 21 and 22 may be partitioned into an upper refrigerator compartment 21 to store food in a chilled state and a lower freezer compartment 22 to store food in a frozen state. The refrigerator compartment 21 may store food in a chilled state at a temperature of about 0 to about 5° C. The freezer compartment 22 may store food in a frozen state at a temperature of about −30 to 0° C. The refrigerator compartment 21 and the freezer compartment 22 may be separated from each other by a middle wall 24.

The freezer compartment 22 may be divided into left and right compartments by a partition wall 25. The partition wall 25 may be integrated with the main body 10 or coupled to the main body 10 as a separate part.

The aforementioned partitioned structure of the storage compartment is an example, and an exemplary embodiment is not limited thereto.

The storage compartments 21 and 22 may be opened and closed by the doors 31, 32, 33, and 34 coupled to the main body 10. According to an exemplary embodiment, the refrigerator includes four doors 31, 32, 33, and 34. The refrigerator compartment 21 may be opened and closed by two upper doors 31 and 32, and the freezer compartment 22 may be opened and closed two lower doors 33 and 34. However, this door structure is an example, and the number and arrangement of doors are not limited thereto.

The cool air supply system may generate cool air by a refrigeration cycle. The cool air supply system may include a compressor (not shown), a condenser (not shown), an expansion device (not shown), an evaporator (not shown), a fan (not shown), and a refrigerant circuit in which a refrigerant is circulated.

The main body 10 may have an approximate box-shape and an open front. The main body 10 includes an inner case 11, an outer case 18 coupled to outer surfaces of the inner case 11, and a foam insulation material 19 filled between the inner case 11 and the outer case 18.

The inner case 11 may be injection-molded using a resin material. The storage compartments 21 and 22 may be formed inside the inner case 11. That is, the inner case 11 may define ranges of the storage compartments 21 and 22.

Figure 13:
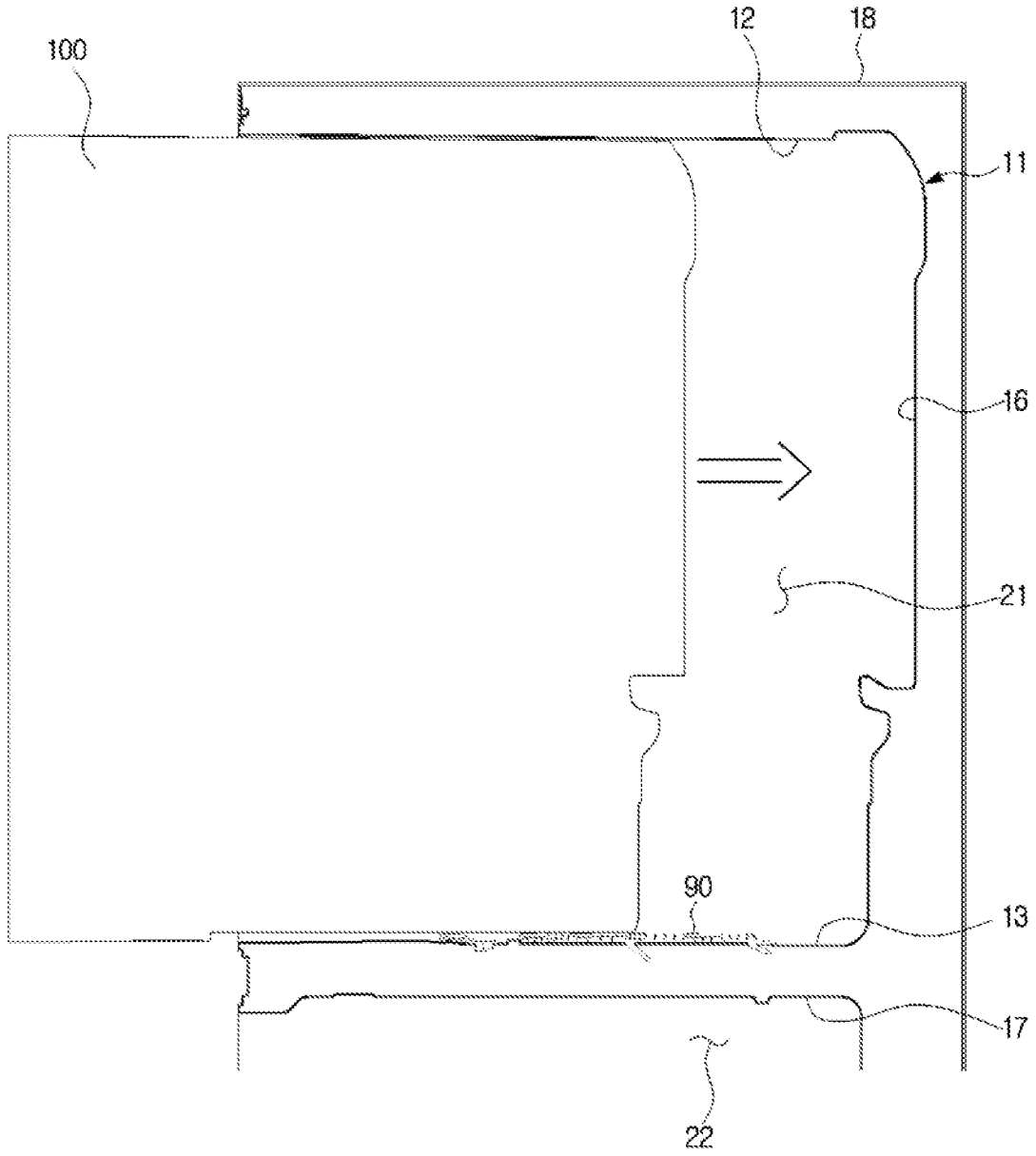
FIG. 13 is a diagram for describing a process of temporarily assembling the support member to the bottom surface of the storage compartment.

The inner case 11 of the upper refrigerator compartment 21 has a top side 12, a bottom side 13, a left side 14, a right side 15, and a rear side 16 surrounding the refrigerator compartment 21 (see, for example, FIGS. 2, 6, and 13).

That is, the top side 12, the bottom side 13, the left side 14, the right side 15, and the rear side 16 constitute a top surface, a bottom surface, a left surface, a right surface, and a rear surface of the refrigerator compartment 21, respectively.

The inner case 11 of the lower freezer compartment 22 has a top side 17 (FIG. 2), a bottom side, a left side, a right side, and a rear side surrounding the freezer compartment 22.

The outer case 18 may be formed of a metallic material and define an appearance of the refrigerator 1.

The foam insulation material 19 may be blown into a space between the inner case 11 and the outer case 18. The foam insulation material 19 includes urethane foam in which urethane and a blowing agent are mixed. The foam insulation material 19 may be filled between the inner case 11 and the outer case 18 after the inner case 11 and the outer case 18 are coupled. Since pressure increasing while blowing the foam insulation material 19 may deform the inner case 11, a fixing jig 100 (see, for example, FIGS. 13 to 15) may be inserted into the inner case 11 to prevent deformation of the inner case 11 while blowing the foam insulation material 19.

The foam insulation material 19 having a high adhesive strength may enhance a binding force between the inner case 11 and the outer case 18. After completion of the blowing process, the foam insulation material 19 may have a sufficient strength. The foam insulation material 19 may fix a side rail unit 70 and a support member 90 to the left and right sides 14 and 15 and the bottom side 13 of the inner case 11.

A vacuum insulation panel may be disposed between the inner case 11 and the outer case 18 in addition to the foam insulation material 19.

Shelves 35 on which food is placed may be arranged in the storage compartment 21. The storage containers 41, 42, and 43 to accommodate food may be arranged in the storage compartment 21. The storage containers 41, 42, and 43 may slide into and out of the storage compartment 21. The storage containers 41, 42, and 43 may be arranged in a horizontal direction.

Since the storage containers 41, 42, and 43 have the same shape with size difference, only the storage container 41 will be described and descriptions for the storage containers 42 and 43 will be omitted.

The storage container 41 includes a body 50 having a storage space 56 and guide units 58 disposed at a right side and a left side of the body 50 of the storage container 41.

The body 50 may have a front wall 51, a rear wall 52, a left wall 53, a right wall 54, and a bottom wall 55. Thus, the storage container 41 may have an open top. Food may be put into and taken out of the storage space 56 through the open top. However, the storage container 41 may also include a cover (not shown) coupled to the body 50 to open and close the open top, thereby store food in a sealed state.

As illustrated in FIG. 5, the left wall 53 and the right wall 54 may be inclined such that an upper width of the storage container 41 is greater than a lower width. Thus, food may be easily put into and taken out of the storage container 41.

The guide units 58 (see, for example, FIG. 4) to guide movement of the storage container 41 may be installed at lower ends of the left wall 53 and the right wall 54. The guide units 58 may be supported by rail units 70 and 80.

The guide units 58 may include guide bars 59 protruding from the lower ends of the left wall 53 and the right wall 54, respectively and extending in a forward-backward direction. The guide bar 59 may be accommodated in guide bar accommodation units 72 and 82 of the rail units 70 and 80, which will be described later. Bottom surfaces of the guide bars 59 may be supported by rail rollers 74 and 84 of the rail units 70 and 80.

The guide units 58 may include guide rollers 60 disposed behind the guide bars 59. The guide roller 60 may move on roller support surfaces 73 and 83 of the rail units 70 and 80.

The storage container 41 may smoothly slide into and out of the storage compartment 21 in the forward-backward direction by interaction between the guide units 58 and the rail units 70 and 80.

The structure in which the guide units 58 are disposed at the lower ends of the left wall 53 and the right wall 54 may reduce a wasted space of the storage space of the storage compartment 21 in comparison with a structure in which guide units are disposed at upper ends of the left wall 53 and the right wall 54.

The refrigerator 1 includes the rail units 70 and 80 installed in the storage compartment 21 to support the storage containers 41, 42, and 43 and guide movement of the storage containers 41, 42, and 43.

The rail units 70 and 80 include side rail units 70 installed at both side surfaces of the storage compartment 21 and central rail units 80 installed at the bottom surface of the storage compartment 21.

According to an exemplary embodiment, three storage containers 41, 42, and 43, a pair of the side rail units 70, and a pair of the central rail units 80 may be provided.

The storage container 41 may be supported by a left side rail unit 70 and a left central rail unit 80, the storage container 42 may be supported by a left central rail unit 80 and a right central rail unit 80, and the storage container 43 may be supported by a right central rail unit 80 and a right side rail unit 70. However, the numbers of the storage containers 41, 42, and 43 and the rail units 70 and 80 are not limited thereto (see, for example, FIG. 16).

The side rail units 70 may be coupled to side surfaces of the storage compartment 21. That is, the side rail units 70 may be coupled to the left side 14 and the right side 15 of the inner case 11.

The left side 14 and the right side 15 of the inner case 11 respectively may have side coupling holes 14*a* and 15*a* (see, for example, FIG. 6) and the side rail units 70 have side coupling protrusions 75.

A plurality of side coupling protrusions 75 may be provided, and some of the side coupling protrusions 75 may have a hook or clamp shape. Thus, as the side coupling protrusions 75 are inserted into the side coupling holes 14*a* and 15*a* and slide thereinto, the side rail units 70 are temporarily assembled to the left and right sides 14 and 15 of the inner case 11.

By blowing the foam insulation material 19 into a space between the inner case 11 and the outer case 18 in a state that the side rail units 70 are temporarily assembled to the inner case 11, the foam insulation material 19 may surround and support the side coupling protrusions 75. Thus, the side rail units 70 may be fixed to the inner case 11.

The side rail unit 70 may include a rail body 71, a guide bar accommodation unit 72 extending in the forward-backward direction to accommodate the guide bar 59 of the storage container 41, a roller support surface 73 to support the guide roller 60 of the storage container 41, and a rail roller 74 disposed in front of the guide bar accommodation unit 72 to support the bottom surface of the guide bar 59 of the storage container 41.

Figure 9:
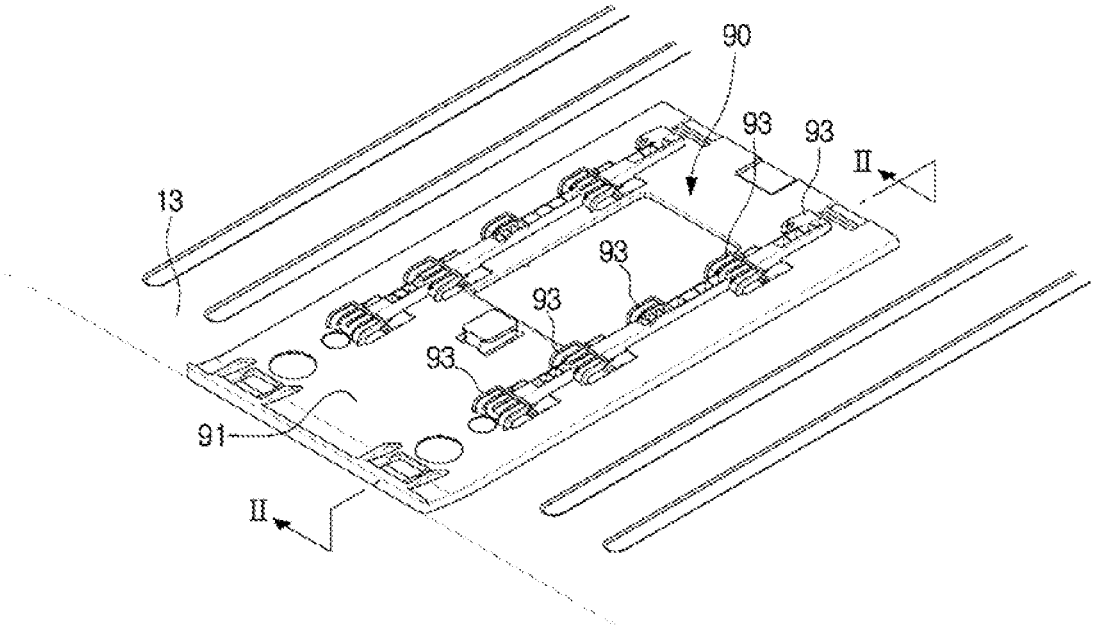
FIG. 9 is a view illustrating a state in which a support member is coupled to the bottom surface of the storage compartment of the refrigerator of FIG. 1.
Figure 10:
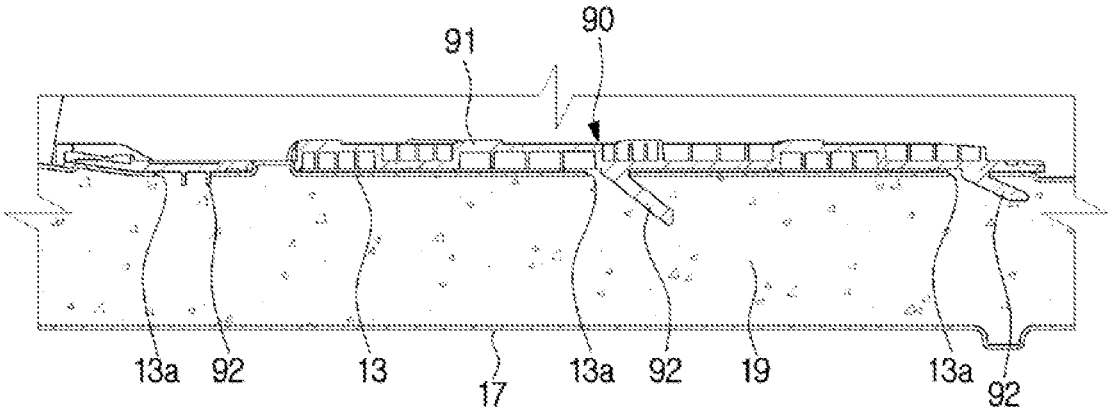
FIG. 10 is a cross-sectional view taken along line II-II of FIG. 9 illustrating a structure in which the support member is fixed to the bottom surface of the storage compartment by the foam insulation material.
Figure 11:
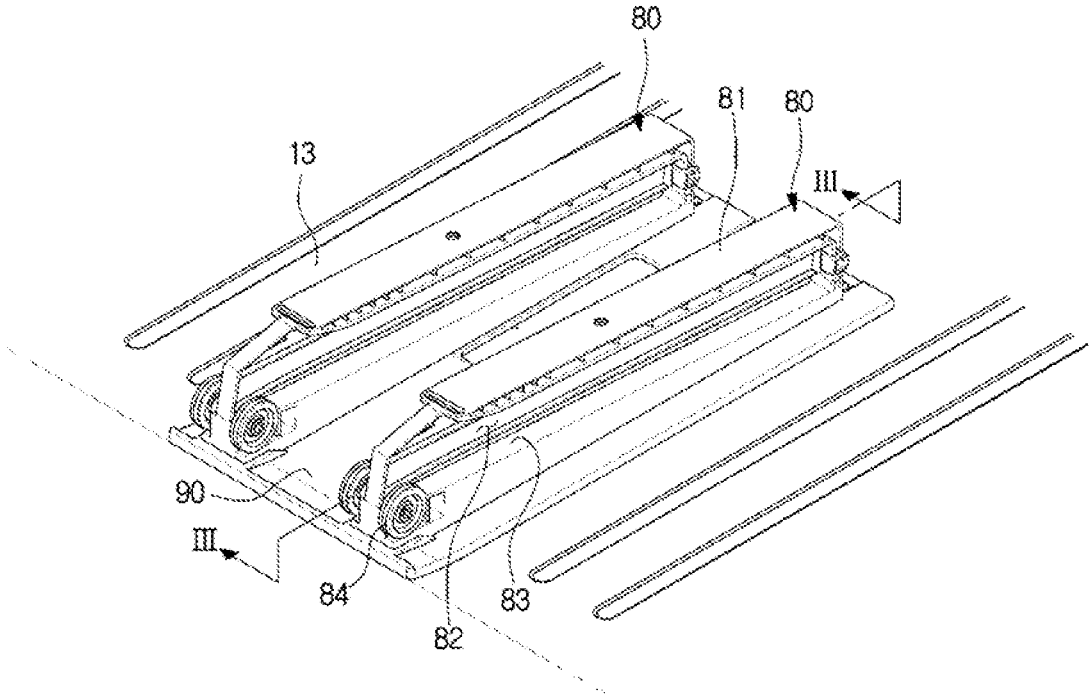
FIG. 11 is a view illustrating a state in which a central rail unit is coupled to the support member of the refrigerator of FIG. 1.
Figure 12:
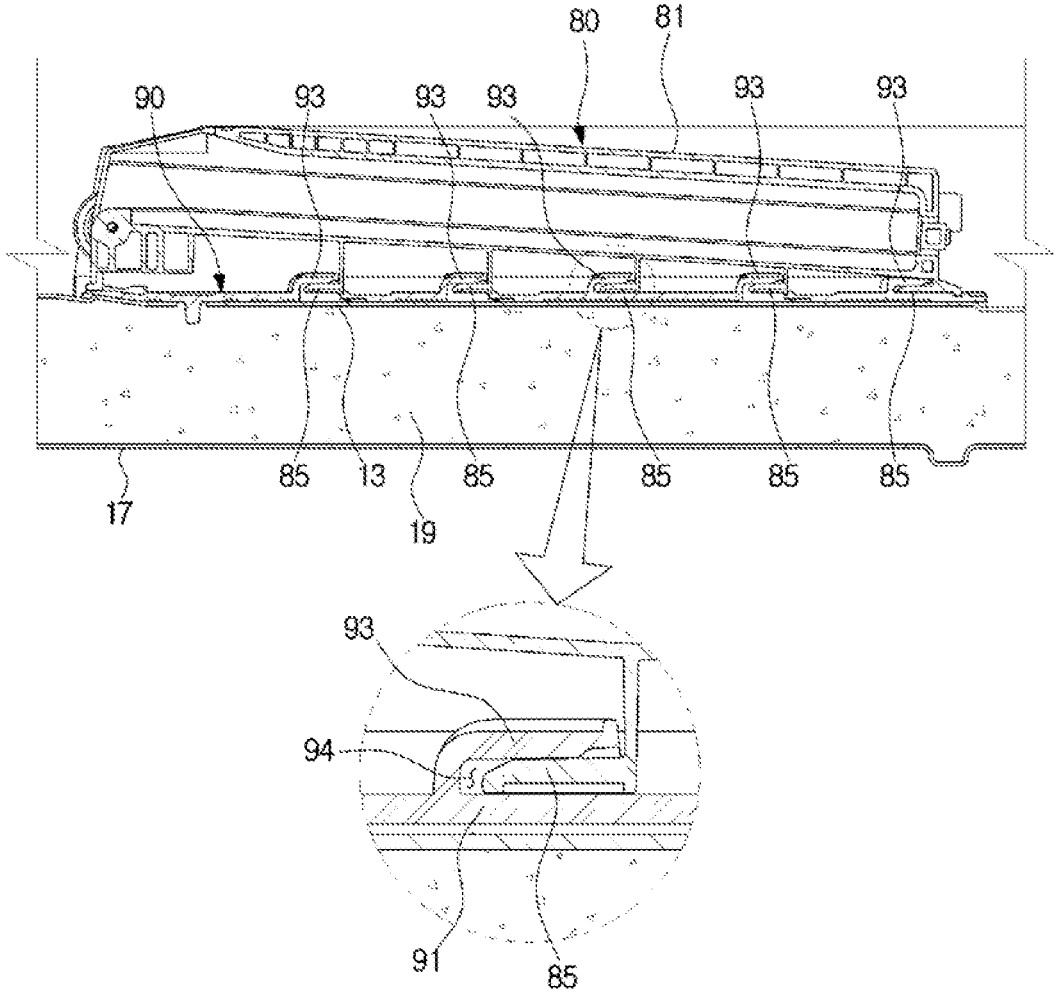
FIG. 12 is a cross-sectional view taken along line III-III of FIG. 11 illustrating a structure in which an insertion protrusion of the central rail unit is inserted into an insertion groove of the support member.

FIG. 9 is a view illustrating a state in which a support member is coupled to the bottom surface of the storage compartment of the refrigerator of FIG. 1. FIG. 10 is a cross-sectional view taken along line II-II of FIG. 9 illustrating a structure in which the support member is fixed to the bottom surface of the storage compartment by the foam insulation material. FIG. 11 is a view illustrating a state in which a central rail unit is coupled to the support member of the refrigerator of FIG. 1. FIG. 12 is a cross-sectional view taken along line III-III of FIG. 11 illustrating a structure in which an insertion protrusion of the central rail unit is inserted into an insertion groove of the support member.

The central rail units 80 and the support member 90 of the refrigerator according to an embodiment are described with reference to FIGS. 9 to 11.

The central rail units 80 are installed at the bottom surface of the storage compartment 21. That is, the central rail units 80 are installed at the bottom side 13 of the inner case 11.

The support member 90 may be disposed between the central rail units 80 and the bottom side 13 of the inner case 11 to stably support the central rail units 80.

The support member 90 may be coupled to the bottom side 13 of the inner case 11 and the central rail units 80 may be coupled to the support member 90. The bottom side 13 of the inner case 11 may be provided with a support member coupling unit 13*b*.

The support member 90 may include a base 91 having a panel shape and disposed in a close contact with the bottom side 13 of the inner case 11 and bottom coupling protrusions 92 protruding downward from the base 91 to be supported by the foam insulation material 19 in a contact state therewith.

The bottom coupling protrusion 92 may pass through the bottom side 13 of the inner case 11. The bottom side 13 of the inner case 11 may have a bottom coupling hole 13*a*. The bottom coupling protrusion 92 may pass thought the bottom coupling hole 13*a* and protrude from the bottom side 13 of the inner case 11 downward.

A plurality of bottom coupling protrusions 92 may be formed, and some of the bottom coupling protrusions 92 may have a hook or clamp shape. Thus, as the bottom coupling protrusions 92 are inserted into the bottom coupling holes 13*a* and slide thereinto, the support member 90 may be temporarily assembled to the bottom side 13 of the inner case 11.

By blowing the foam insulation material 19 into a space between the inner case 11 and the outer case 18 in a state that the support member 90 is temporarily assembled to the inner case 11, the foam insulation material 19 may surround and support the bottom coupling protrusions 92. Thus, the support member 90 may be fixed.

After the support member 90 is fixed to the bottom side 13 of the inner case 11 by blowing the foam insulation material 19 into the space between the inner case 11 and the outer case 18, the central rail units 80 may be coupled to the support member 90.

The central rail units 80 may be coupled to the support member 90 by press fit. That is, the central rail units 80 may be coupled to the support member 90 by inserting portions of the central rail units 80 into the support member 90 by sliding.

The central rail units 80 include insertion protrusions 85 disposed at lower portions of the rail bodies 81, and the support member 90 includes hook portions 93 constituting insertion grooves 94 into which the insertion protrusions 85 are inserted (see, for example, FIG. 12).

The hook portions 93 protrude upward from the base 91 and have a hook or clamp shape such that the insertion grooves 94 are formed between the hook portions 93 and the base 91.

The hook portions 93 may be elastically deformed. Thus, as the insertion protrusions 85 are inserted into the insertion grooves 94, the hook portions 93 are slightly spread accumulating elasticity. The accumulated elastic force presses the insertion protrusions 85 such that coupling between the central rail units 80 and the support member 90 may be maintained. However, if the rail units are pulled with a force greater than the elasticity, the central rail units 80 may be separated from the support member 90.

A coupling structure of the bottom side 13 of the inner case 11 and the support member 90 and a coupling structure of the support member 90 and the central rail units 80 do not require a separate coupling member since the foam insulation material 19 and structures thereof are used for the coupling processes. Thus, coupling thereof may be simply performed using a reduced number of parts.

Similarly to the side rail unit 70, the central rail unit 80 may include a rail body 81, a guide bar accommodation unit 82 extending in the forward-backward direction to accommodate the guide bar 59 of the storage container 41, a roller support surface 83 to support the guide roller 60 of the storage container 41, and a rail roller 84 disposed in front of the guide bar accommodation unit 82 to support the guide bar 59 of the storage container 41.

However, a pair of each of the guide bar accommodation units 82, the roller support surfaces 83, and the rail rollers 84 may be disposed at left and right sides of the central rail unit 80, which is different from the side rail unit 70.

Figure 14:
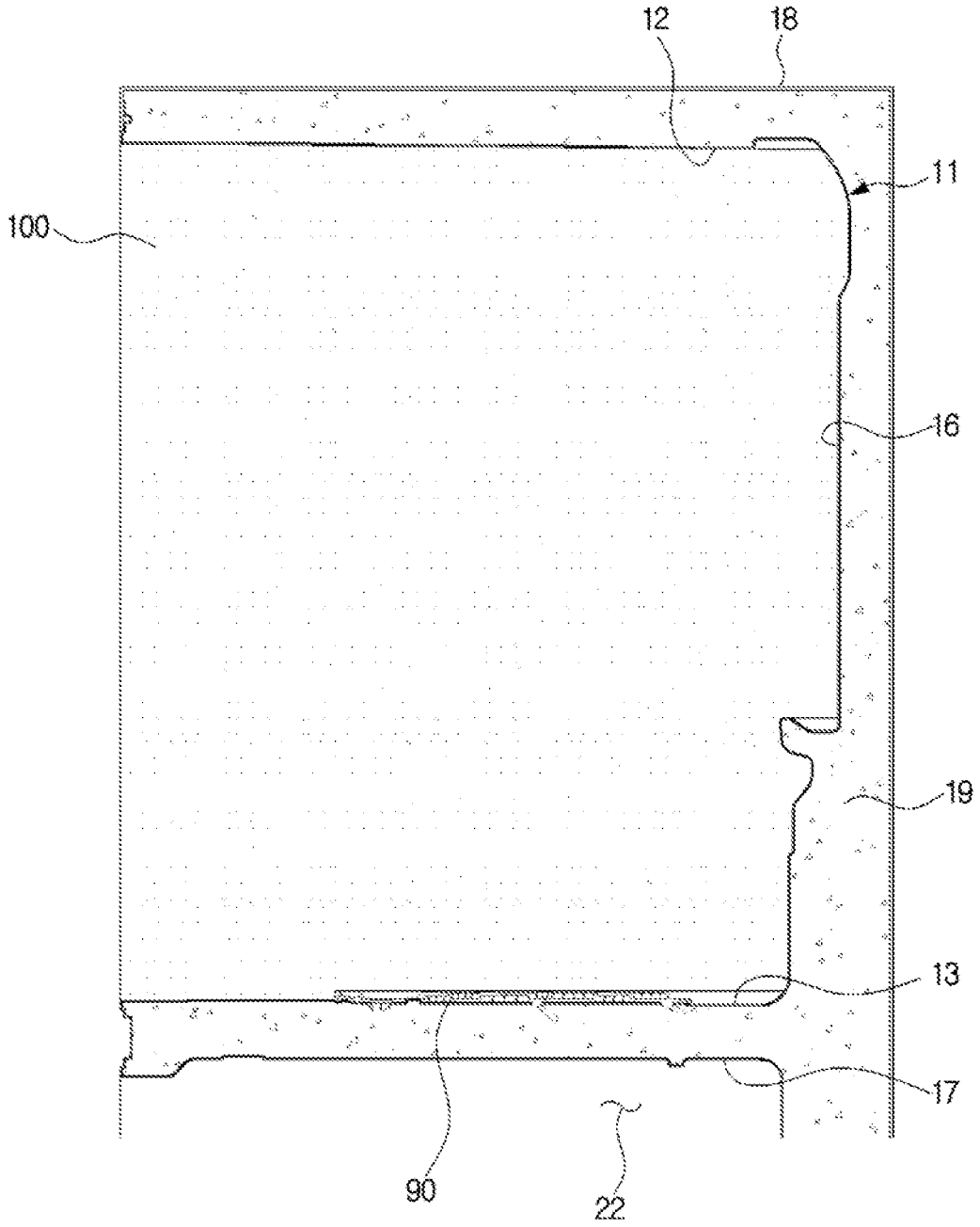
FIG. 14 is a diagram for describing a process of blowing the foam insulation material into a space between the inner case and the outer case while a jig is inserted into the storage compartment.
Figure 15:
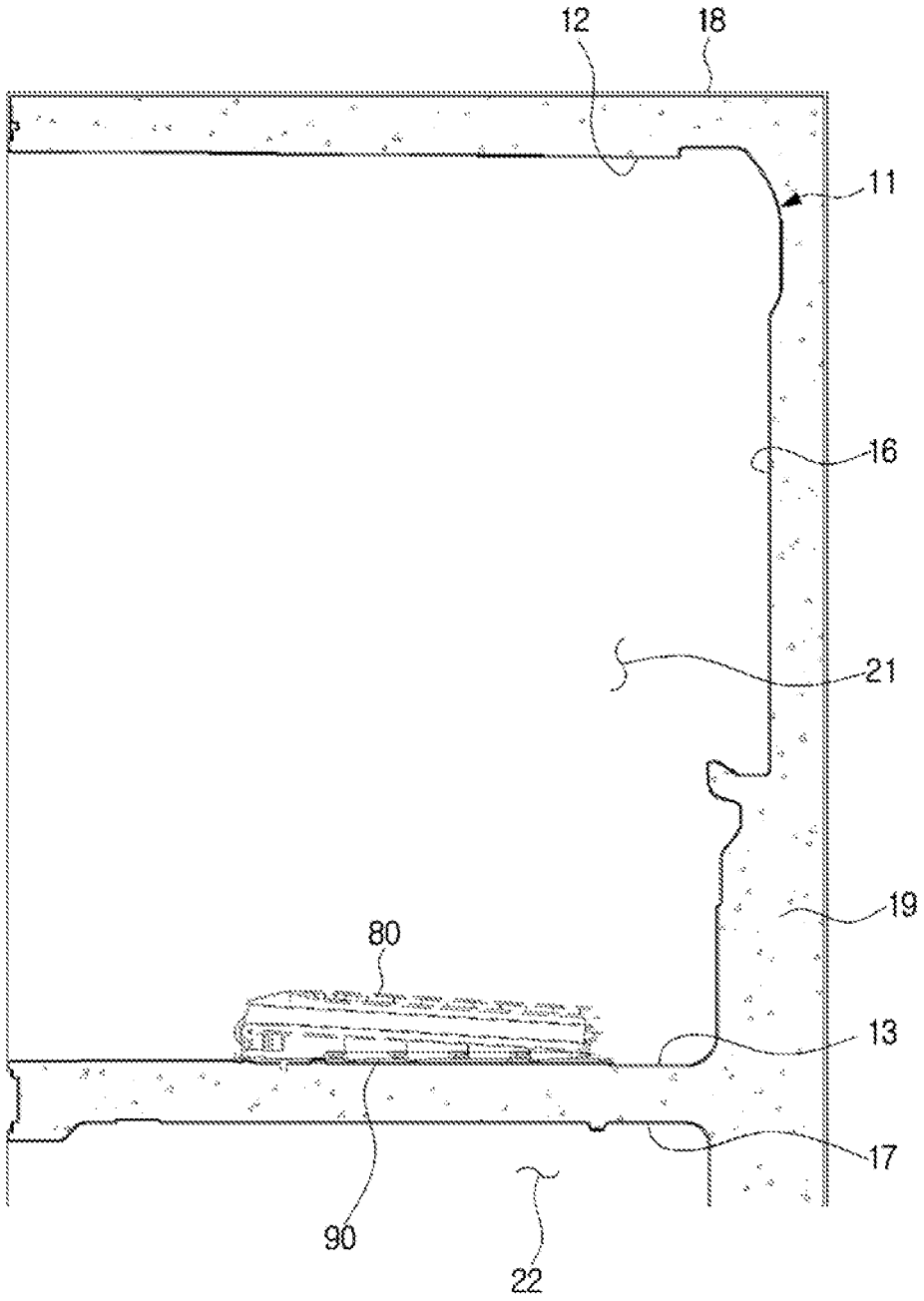
FIG. 15 is a diagram for describing a process of coupling the central rail unit to the support member after blowing the foam insulation material.

FIGS. 13 to 15 are diagrams for describing an installation process of a central rail unit of the refrigerator of FIG. 1. FIG. 13 is a diagram for describing a process of temporarily assembling the support member to the bottom surface of the storage compartment. FIG. 14 is a diagram for describing a process of blowing the foam insulation material into a space between the inner case and the outer case while a jig is inserted into the storage compartment. FIG. 15 is a diagram for describing a process of coupling the central rail unit to the support member after blowing the foam insulation material.

Referring to FIGS. 13 to 15, the installation process of the central rail unit 80 and the side rail unit 70 of the refrigerator according to an embodiment will be described.

As illustrated in FIG. 13, the support member 90 is temporarily assembled to the bottom side 13 of the inner case 11. The support member 90 may be temporarily assembled to the bottom side 13 of the inner case 11 by inserting the bottom coupling protrusions 92 of the support member 90 into the bottom coupling holes 13*a* of the bottom side 13 of the inner case 11 and sliding thereinto.

In this case, although not shown in the drawings, the side rail units 70 may also be temporarily assembled to the left and right sides 14 and 15 of the inner case 11. The side rail units 70 may be temporarily assembled to the left and right sides 14 and 15 of the inner case 11 by inserting the side coupling protrusions 75 of the side rail units 70 into the side coupling holes 14*a* and 15*a* of the left and right sides 14 and 15 of the inner case 11 and sliding thereinto.

After completion of temporary assembling, the fixing jig 100 is inserted into the storage compartment 21 to prevent deformation of the inner case 11 by a pressure increasing while blowing the foam insulation material 19 or prevent separation of the support member 90 and the side rail unit 70 temporarily assembled to the inner case 11 from the inner case 11.

After completion of the fixing jig 100, the foam insulation material 19 is blown into the space between the inner case 11 and the outer case 18 as illustrated in FIG. 14.

Since the support member 90 may have a thin panel shape, the fixing jig 100 may be inserted to be close to the bottom side 13 of the inner case 11 as illustrated in FIG. 14. Thus, the fixing jig 100 may efficiently prevent deformation of the bottom side 13 of the inner case 11 while blowing the foam insulation material 19.

However, if the support member 90 is integrated with the central rail units 80, which is different from the present embodiment, the fixing jig 100 should be spaced apart from the bottom side 13 of the inner case 11 by a height of the central rail units 80 to prevent interference between the central rail units 80 and the fixing jig 100 while inserting the fixing jig 100. In this case, deformation of the bottom side 13 of the inner case 11 may not be efficiently prevented.

After completion of blowing the foam insulation material 19, the fixing jig 100 may be removed from the storage compartment 21 and the central rail units 80 may be coupled to the support member 90 as illustrated in FIG. 15.

The central rail units 80 may be coupled to the support member 90 by inserting the insertion protrusions 85 of the central rail units 80 into the insertion groove 94 of the support member 90 by press fit.

Figure 16:
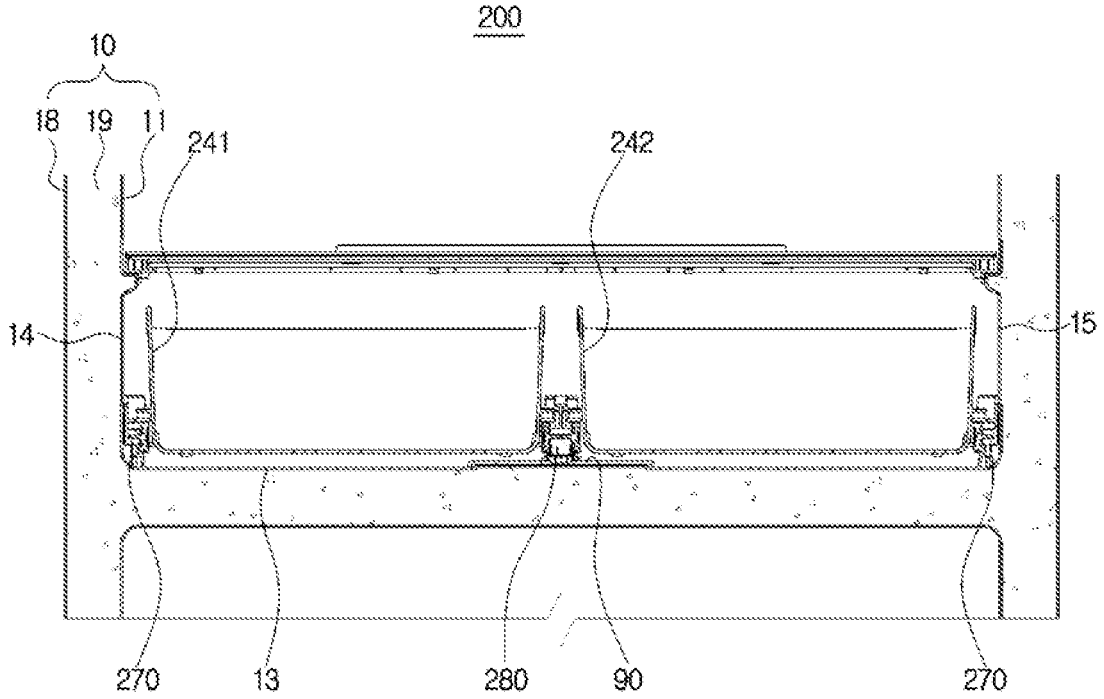
FIG. 16 is a front cross-sectional view of a refrigerator according to another embodiment.

FIG. 16 is a front cross-sectional view of a refrigerator according to another embodiment.

An exemplary embodiment of a refrigerator is described with reference to FIG. 16. The same reference numerals are used to the same elements described above, and descriptions thereof may not be repeated.

A refrigerator 200 may have two storage containers 241 and 242 which is different from the aforementioned embodiment. A pair of side rail units 270 and a central rail unit 280 may be provided in a storage compartment to support storage containers 241 and 242 and guide movement thereof.

A left side rail unit 270 may be installed at the left side 14 of the inner case 11, a right side rail unit 270 may be installed at the right side 15 of the inner case 11, and the central rail unit 280 may be installed at the bottom side 13 of the inner case 11.

The support member 90, which is coupled to the bottom side 13 of the inner case 11 to support the central rail unit 280, may be disposed between the central rail unit 280 and the bottom side 13 of the inner case 11.

The support member 90 may be fixed by the foam insulation material 19 blown into the space between the inner case 11 and the outer case 18. The central rail unit 280 and the support member 90 may be coupled by press fit without using a separate coupling member.

Since the guide bars that guide movement of the storage containers are installed not at upper ends of the storage container but at lower ends thereof, a storage space wasted by the guide bars and the rail units supporting the guide bars may be reduced in the storage compartment.

According to the above descriptions, since the roller units are installed at the bottom surface of the storage compartment by using the foam insulation material blown into the space between the inner case and the outer case and the coupling structure of the roller unit without using a separate coupling member, a process of assembling the refrigerator may be easily performed.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

an inner case, in which at least one storage compartment is formed, the inner case having at least a left side, a right side, an upper side, and a bottom side surrounding the at least one storage compartment;

an outer case coupled to an one outer surface of the inner case;

a foam insulation material blown into a space between the inner case and the outer case;

at least one storage container slidable into and out of the at least one storage compartment;

a side rail member coupled to a side surface of the at least one storage compartment, the side rail member being configured to moveably guide a movement of the at least one storage container;

at least one support member disposed in the at least one storage compartment, the at least one support member being coupled to the bottom side of the inner case; and a central rail member formed to be entirely supported by the at least one support member by being coupled to a top surface of the at least one support member, where the central rail member is configured to guide the movement of the at least one storage container, wherein the at least one support member is fixed by the foam insulation material.

2. The refrigerator according to claim 1, wherein the at least one support member comprises a coupling protrusion passable through the bottom side of the inner case to contact the foam insulation material and to be supported by the foam insulation material.

3. The refrigerator according to claim 2, wherein the bottom side of the inner case has a coupling hole through which the coupling protrusion passes.

4. The refrigerator according to claim 3, wherein the at least one support member is temporarily assembled to the bottom side of the inner case as the coupling protrusion is inserted into the coupling hole and slides thereinto.

5. The refrigerator according to claim 1, wherein the foam insulation material is blown into the space between the inner case and the outer case after the at least support member is temporarily assembled to the bottom side of the inner case.

6. The refrigerator according to claim 1, wherein the central rail member is coupled to the at least one support member after blowing the foam insulation material into the space.

7. The refrigerator according to claim 1, wherein the central rail member is coupled to the at least one support member as a portion of the central rail member is slidably inserted into the at least one support member.

8. The refrigerator according to claim 7, wherein the central rail member has an insertion protrusion couplable to the at least one support member.

9. The refrigerator according to claim 8, wherein the at least one support member comprises a hook portion including an insertion groove into which the insertion protrusion is inserted.

10. A refrigerator comprising:

an inner case, in which at least one storage compartment is formed, the inner case having a plurality of sides with at least some of the plurality of sides of the inner case facing at least some portions of the at least one storage compartment;

an outer case coupled to an least one outer surface of the inner case;

a foam insulation material blown into a space between the inner case and the outer case;

at least one storage container slidable into and out of the at least one storage compartment;

at least one rail unit configured to guide a movement of the at least one storage container; and at least one support member disposed in the at least one storage compartment to support the at least one rail unit and coupled to a bottom side of the plurality of sides of the inner case, wherein the at least one rail unit is coupled to the at least one support member as a portion of the at least one rail unit is slidably inserted into the support member, wherein the at least one rail unit has an insertion protrusion couplable to the at least one support member, wherein the at least one support member comprises a hook portion including an insertion groove into which the insertion protrusion is insertable, and wherein the hook portion is elastically deformed as the insertion protrusion is inserted into the insertion groove and coupling of the at least one rail unit and the at least one support member is maintained by pressing the insertion protrusion with elasticity.

* * * * *